US007318333B2

(12) United States Patent
Allor et al.

(10) Patent No.: US 7,318,333 B2
(45) Date of Patent: Jan. 15, 2008

(54) SUPERPLASTIC FORMING TOOL

(75) Inventors: Richard Allor, Livonia, MI (US); Peter Friedman, Ann Arbor, MI (US); Warren Copple, Trenton, MI (US); George Luckey, Jr., Dearborn, MI (US)

(73) Assignee: Ford Global Technologies, L.L.C., Dearborn, MI (US)

( * ) Notice: Subject to any disclaimer, the term of this patent is extended or adjusted under 35 U.S.C. 154(b) by 0 days.

(21) Appl. No.: 11/132,042

(22) Filed: May 18, 2005

(65) Prior Publication Data

US 2006/0260373 A1 Nov. 23, 2006

(51) Int. Cl.
*B21D 26/02* (2006.01)

(52) U.S. Cl. ..... 72/60; 72/57; 29/421.1

(58) Field of Classification Search ..... 72/56–63, 72/709; 29/421.1
See application file for complete search history.

(56) References Cited

U.S. PATENT DOCUMENTS 3,340,101 A 9/1967 Fields, Jr. et al.
3,975,936 A * 8/1976 Baldwin et al. ..... 72/38
4,045,986 A 9/1977 Laycock et al.
4,266,416 A 5/1981 Festag et al.
4,901,552 A * 2/1990 Ginty et al. ..... 72/60
4,936,128 A * 6/1990 Story et al. ..... 72/60
5,647,239 A 7/1997 Fischer
5,823,032 A 10/1998 Fischer
5,916,316 A 6/1999 Fischer
6,098,438 A * 8/2000 Fischer ..... 72/60
6,253,588 B1 * 7/2001 Rashid et al. ..... 72/57
6,615,631 B2 * 9/2003 Kleber et al. ..... 72/60
6,672,121 B2 * 1/2004 Carsley et al. ..... 72/57
2004/0074273 A1 4/2004 Kim et al.

FOREIGN PATENT DOCUMENTS

JP 1197020 8/1989

* cited by examiner

*Primary Examiner*—David B. Jones
(74) *Attorney, Agent, or Firm*—Tung & Associates; Raymond L. Coppiellie

(57) ABSTRACT

A superplastic forming tool for forming a workpiece to make a part. The forming tool includes a forming die having first and second die members. At least one of the die members having a cavity including a forming surface and a plenum. A plurality of passageways extend between the plenum and the cavity. The passageways allow passage of fluid between the cavity and the plenum.

20 Claims, 3 Drawing Sheets

SUPERPLASTIC FORMING TOOL

CROSS-REFERENCE TO RELATED APPLICATIONS

Not Applicable.

BACKGROUND OF THE INVENTION

1. Field of the Invention

The present invention relates generally to superplastic forming of a workpiece; and, more specifically to a forming tool and method used to form a workpiece.

2. Description of Related Art

Superplastic forming (SPF) takes advantage of a material's superplasticity or ability to be strained past its rupture point under certain elevated temperature conditions and strain rates. Superplasticity in metals is defined by very high tensile elongations, ranging from two hundred to several thousand percent. SPF is a process that can be used to produce parts that takes advantage of the high elongation behavior of certain superplastic materials.

SPF typically includes the steps of heating a sheet of material to a point in which superplastic deformation is possible, clamping the material within a sealed die and then using gas pressure to force the material to stretch and take the shape of a forming surface located in the die cavity. Controlling the gas pressure during the forming process controls the deformation rate of the material and maintains superplasticity at the elevated temperature.

Superplastic forming process can lead to part thinning and strain localization in certain areas, such as corners of the mold cavity. Typically, the workpiece stretches or thins in a uniform manner in the open area of the die cavity. Once the workpiece engages the mold surface of the die cavity, deformation or thinning in the contact area is restricted resulting in a greater amount of workpiece stretching or thinning in the last area to contact the die surface. To increase control of the thinning problem and correspondingly control thickness distribution the workpiece can be pre-stretched. That is, the workpiece is pre-stretched or pre-thinned in certain areas depending upon the ultimate configuration of the die cavity. Once the workpiece is successfully pre-stretched, pressure is applied to form the workpiece by pressing it against the mold surface of the forming die.

One process for pre-stretching a workpiece entails blow forming the workpiece away from the molding surface to create a pre-form bubble. After sufficiently stretching the workpiece, reverse pressure then forces the workpiece into the die cavity and against the mold surface. In order to perform such a process, the forming tool must be designed to have a sealed pressure system on both sides of the workpiece and include a pre-form cavity located in the forming tool opposite the molding surface.

SUMMARY OF THE INVENTION

The present invention is a superplastic forming tool for forming a workpiece. The forming tool includes a forming die having first and second die members that move between a first open position and a second closed position. At least one of the first and second die members having a cavity including a mold surface. The die member further having a recess. A cap attached to the die member covers the recess such that the cap cooperates with the recess to create a plenum. An aperture in the die member enables communication with the plenum and provides an entryway for supplying pressure to the plenum. A plurality of passageways extend from the plenum to the cavity. The passageways allow passage of fluid between the cavity and the plenum.

In a further embodiment of the invention, both the first and second die members include a cavity and a plenum. A plurality of passageways extend between the plenum and the cavity to allow fluid communication between the plenum and mold cavity.

The present invention further includes a method for reverse gas pressure superplastic forming. The method includes providing a superplastic forming tool, the forming tool having first and second die members each of the die members having a plenum, a mold cavity and a plurality of passageways extending between the plenum and the mold cavity. Further steps include placing a workpiece between the first and second die members and closing the die members to sandwich the workpiece in a sealed relationship between the first and second die members. A pressure source supplies pressure to the plenum and correspondingly through said passageways on said first die member to one side of the workpiece to urge the workpiece toward said second die member. Once the workpiece is sufficiently pre-stretched, applying pressure through said plenum and correspondingly said passageways of said second die member against the opposite side of said workpiece to urge said workpiece toward the first die member. Continuously applied pressure against one side of the workpiece forces the workpiece against the mold cavity of the first die member to ultimately form the workpiece.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
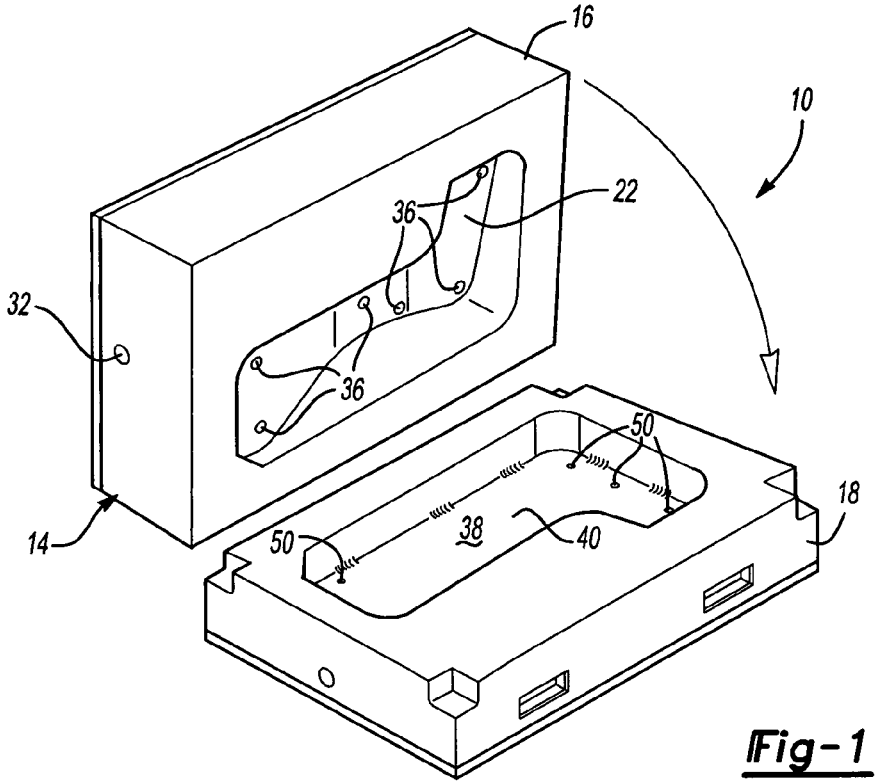
FIG. 1 is a forming tool used for superplastic forming a workpiece according to the present invention.
Figure 3:
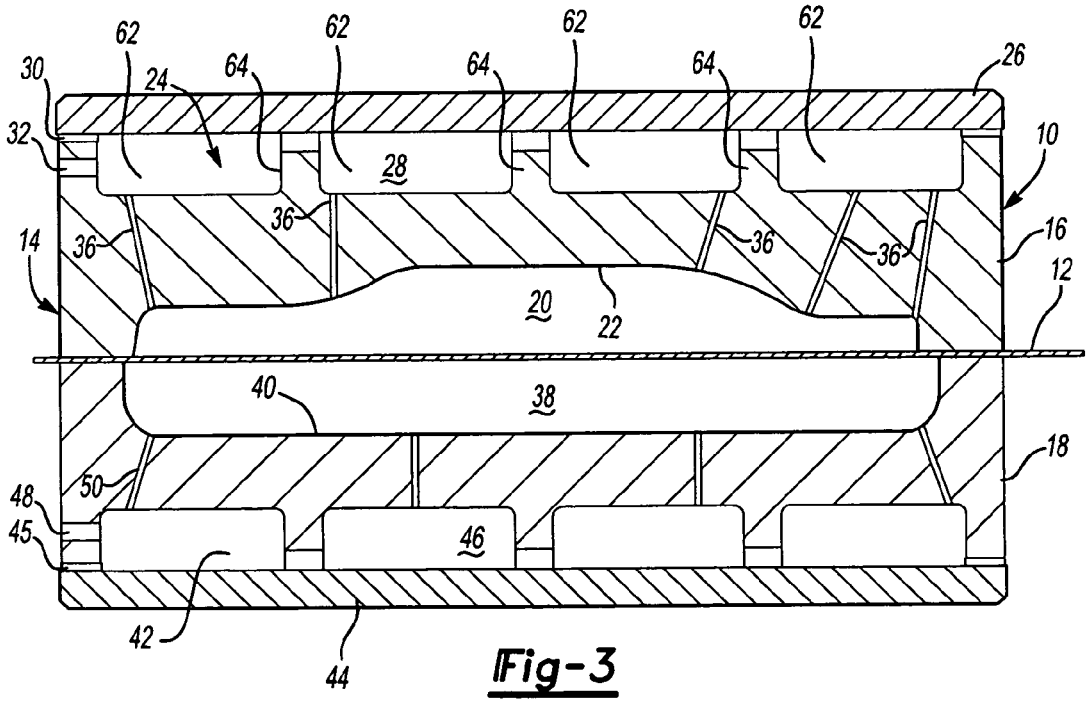
FIG. 3 is a cross-sectional view of a forming tool according to the embodiment shown in FIG. 1 with a workpiece placed between the respective die members.
Figure 2:
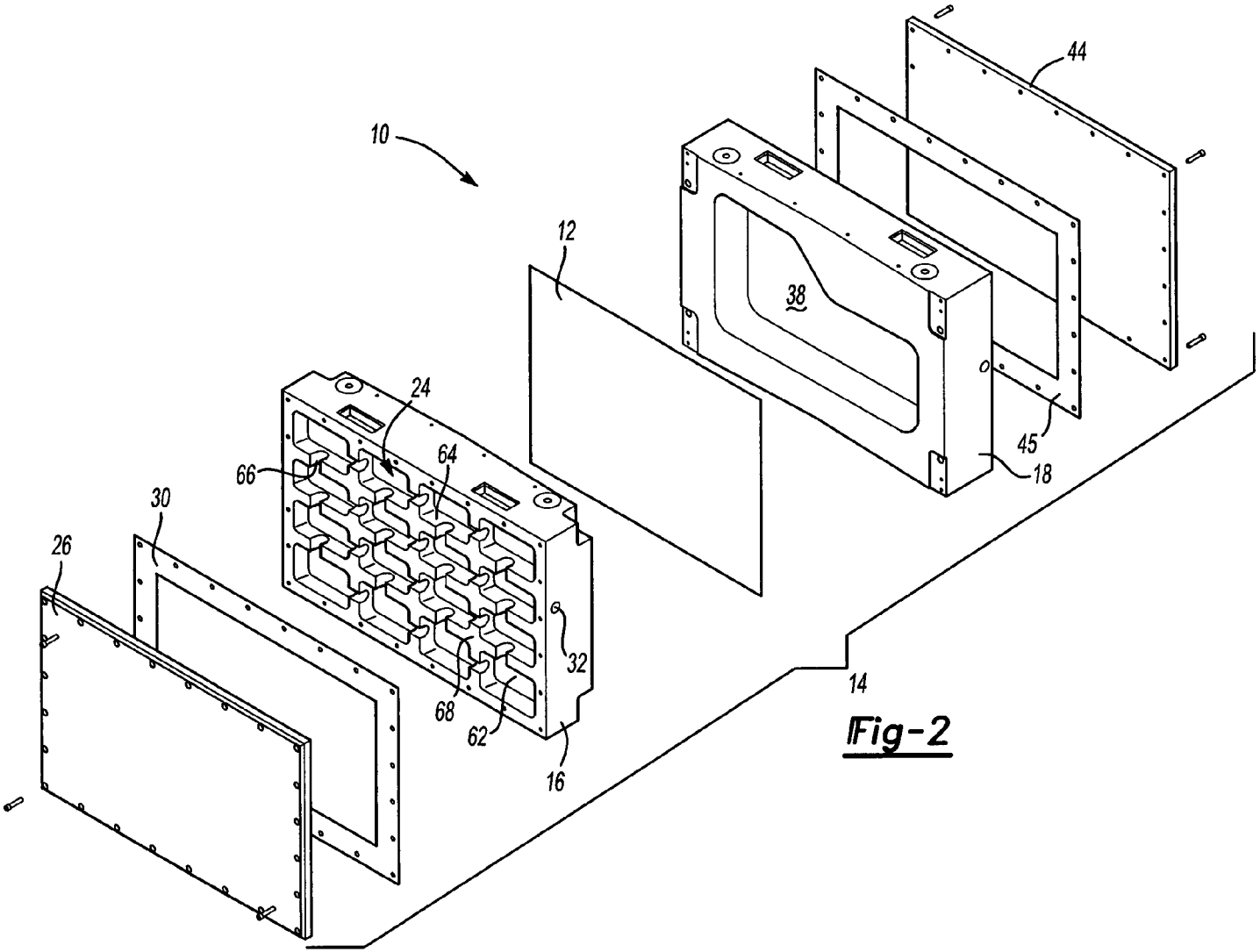
FIG. 2 is an exploded view of the forming tool of FIG. 1.

Referring now to the drawings, FIGS. 1–3 illustrate a forming tool 10 according to the present invention for forming a workpiece 12 using a superplastic forming process. The forming tool 10 includes a forming die 14 having upper 16 and lower 18 die members operative to move between an open and a closed position. Placing the upper and lower die members 16, 18 in a closed position, as illustrated in FIG. 3, sandwiches the workpiece 12 between the respective upper and lower die members 16, 18.

The upper die member 16 includes a mold cavity 20 having a mold surface 22. The upper die member 16 further includes a recess or hollow portion 24. Connected to the upper die member 16 is a cap 26 that extends over and covers the recess 24 to create a chamber or plenum 28. Placed between the cap 26 and the die member 16 is a gasket 30 that seals the cap 26 to prevent leakage from the chamber or plenum 28. The gasket 30 is made of a material such as aluminum or copper that withstands superplastic forming temperatures. An aperture 32 in the upper die member 16 communicates with the plenum 28. A pressure source supplies pressure through the aperture 32 to the plenum 28. Typically, the pressure source is a supply of pressurized gas used in the superplastic forming process. Various gases are used, typically depending upon the composition of the material being formed.

A plurality of passageways 36 located in the upper die member 16 extend from the plenum 28 to the mold cavity 20. The passageways 36 are placed in those areas or regions of the mold surface 22 of the upper die member 16 that may form an enclosed area within the mold cavity 20 when the workpiece 12 contacts the mold surface 22. Accordingly, for a mold surface 22 having a complex geometry there may be many passageways 36. The passageways 36 all connect to the plenum 28 to produce a sealed pressure cavity.

The lower die member 18 also includes a cavity 38 having a forming surface 40. The lower die member 18 further includes a recess or hollow portion 42. Connected to the lower die member 18 is a cap 44 that extends over and covers the recess 42 to create a chamber or plenum 46 in the lower die member 18. Once again, a gasket 45 placed between the die 44 and the lower die member 18 seals the cap 44 to prevent leakage from the chamber or plenum 46. An aperture 48 in the lower die member 18 communicates with the plenum 46 whereby fluid pressure from a pressure source is supplied to the plenum 46. Specifically, the fluid pressure in the plenum 46 may be increased or decreased by transferring fluid either in or out of the plenum 46 through the aperture 48.

A plurality of passageways 50 located in the lower die member 18 extend from the plenum 46 to the cavity 38. The passageways 50 are placed in those parts of the lower die member 18 that may form an enclosed area 54 within the cavity 38. Depending upon the geometry of the cavity 38 formed in the lower die member 18 multiple passageways 50 may extend from the cavity 38 to the plenum 46. As with the upper die member 16 the passageways 50 all communicate with the plenum 46 located in the lower die member 18 to produce a sealed pressure cavity.

As shown, the recess 24 formed in the upper die member 16 and the recess 42 formed in the lower die member 18 each include a plurality of pockets 62 separated by a plurality of web members 64 and interconnected by channels or grooves 66 located in each of the web members 64. Thus, each recess 24, 42 includes a plurality of upright members or lands 68. The upright members 68 engage the respective cap members 26, 44 and help support the cap members 26, 44 on the upper die member 16 and lower die member 18. Forming the recesses 24, 42 of the upper and lower die members 16, 18 and a lattice or web arrangement is one way to reduce the overall weight of the die members 16, 18 while maintaining structural strength. Another way is to form the recesses 24, 42 in the upper and lower die members 16, 18 as an open area or large cavity without the lattice or web arrangement.

The superplastic forming die or forming tool 10 according to the present invention is useful for reverse gas-pressure superplastic forming. Reverse gas pressure superplastic forming involves applying pressure to both sides of the workpiece during the forming process and is particularly useful to pre-stretch the workpiece before the final forming step. During the superplastic forming process, the forming tool 10 is generally heated to and maintained at a superplastic forming temperature. The most common heat source is electrical heating; typically, resistance type heating elements located in the press platens that provide a heat source to maintain the forming tool 10 at forming temperature. In some instances, heating units are placed directly in the forming tool 10. Accordingly, the forming tool 10 is heated to forming temperature and is subjected internally to gas forming pressures.

Figure 4:
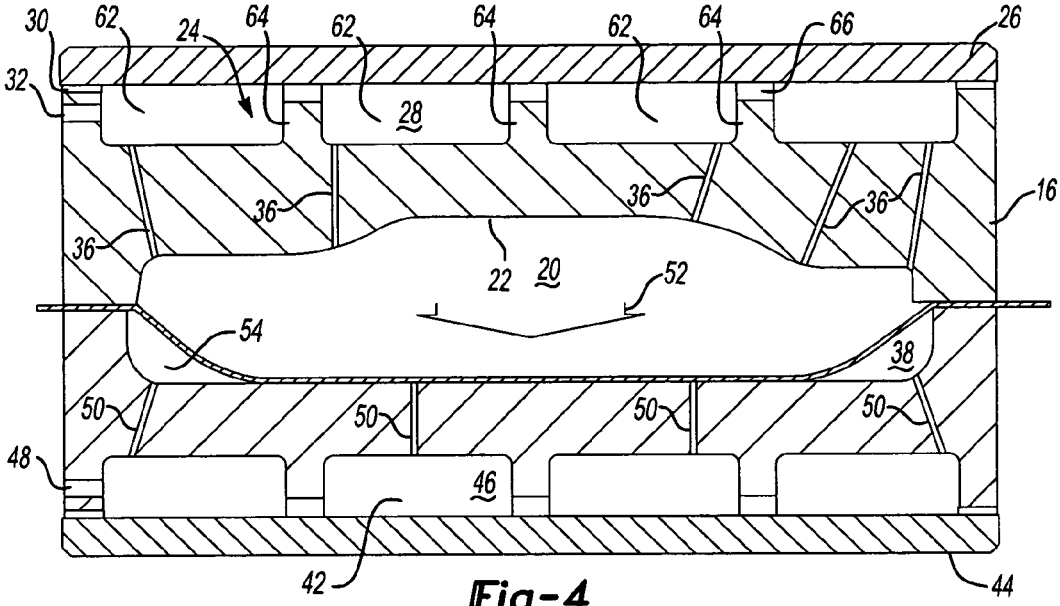
FIG. 4 is a cross-sectional view of the forming tool as shown in FIG. 3 illustrating the workpiece in a pre-formed condition.
Figure 5:
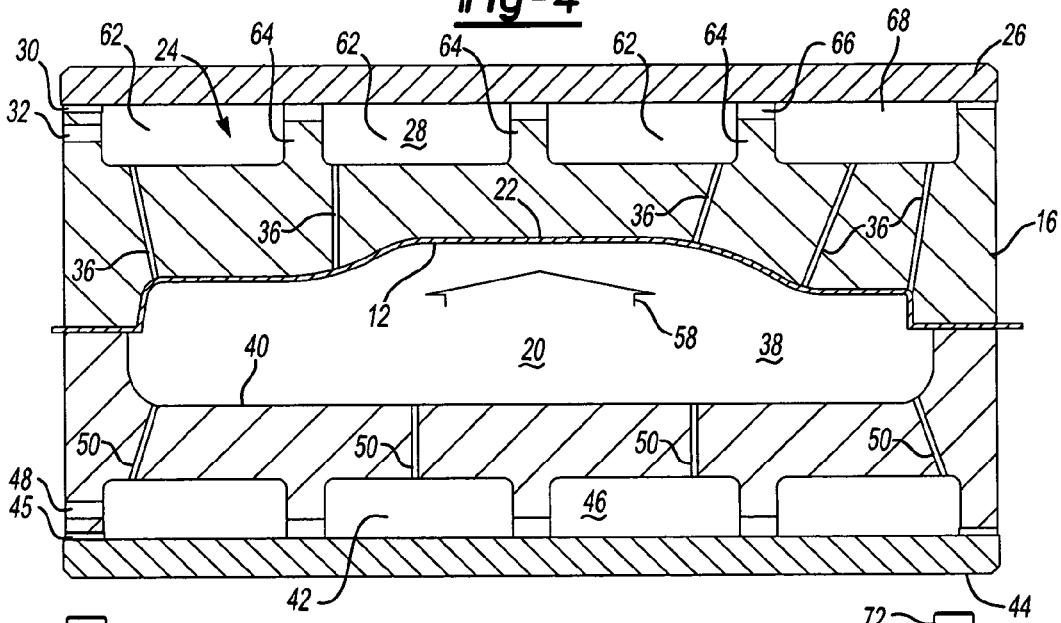
FIG. 5 is a cross-sectional view of the forming tool as shown in FIG. 3 illustrating the workpiece formed against the forming surface.

Specifically, as shown in FIGS. 3–5, a workpiece 12 is sandwiched between the respective heated upper and lower die members 16, 18. In some instances, the workpiece may be preheated prior to placing it in the forming tool 10. As illustrated in FIG. 4, pressure from a pressure source (not shown), typically gas pressure from a gas storage system, enters the plenum 28 of the upper die member 16 through the aperture 32 and travels through the respective passageways 36 to urge or drive the workpiece 12 downward in the direction shown by the arrow 52.

As the workpiece 12 is driven downward and contacts the of forming surface 40 of the lower die member 18, the gas or fluid contained in the cavity 38 in the lower die member 18 escapes or vents through the passageways 50 into the plenum 46 and correspondingly through the aperture 48. The aperture 48 is connected to a pressure source (not shown.) A vent valve, connected to a line extending between the pressure source and the plenum 46, operates to vent the pressure from the plenum 46 to the atmosphere. Using an inert gas during the forming process enables venting the gas to the atmosphere. While in the preferred embodiment the gas is vented to the atmosphere, in an alternative embodiment, the pressure or gas contained in the plenum 46 can be contained and returned to the pressure source or other storage means. In this manner, the gas is contained in the plenum 46 and pressure source and is not vented to the atmosphere. While some pressurized gases or fluids can be vented to the atmosphere, others due to either cost or toxicity need to be contained.

As illustrated in FIG. 4, the passageways 50 provide a mechanism to vent the pressure trapped in the fully enclosed area 54 and enables the workpiece 12 to fully contact the forming surface 40. Driving the workpiece into the cavity 38 in the lower die member 18 pre-stretches the workpiece 12. After the workpiece 12 is pre-stretched, which in some cases includes fully forming the workpiece 12 against the forming surface 40 of the lower die member 18, the pressure in the plenum 46 is increased whereby the fluid flow direction is reversed and fluid flows from the plenum 46 through the passageways 50 into the cavity 38. Increasing the pressure in the cavity 38 drives the workpiece 12 in the opposite direction, as illustrated by the arrow 58 in FIG. 5, towards and ultimately against the forming surface 22 of the upper die member 16. As the workpiece 12 moves toward and ultimately contacts the molding surface 22 the pressure in the cavity 20 is vented through the passageways 36 to the plenum 28 and correspondingly out the aperture 32 where, as set forth above, it is vented to the atmosphere or recaptured and held in a storage means for reuse or reclamation.

Accordingly, the reverse gas-pressure superplastic forming process has two main elements, first applying pressure on one side of the workpiece 12 to create a pre-stretched or pre-formed workpiece 12 in the cavity 38 located in the lower die member 18. Second, applying pressure to the opposite side of the workpiece 12 and driving the workpiece 12 into the molding or forming cavity 20 and against the mold surface 22. Accordingly, both the upper and lower die members 16, 18 have plenums 28, 46 and passageways 36, 50 that enable both die members 16, 18 to both supply and vent pressure in their respective die cavities 20, 38.

In a further embodiment, the apparatus according to the present invention is suitable for use with differential forming pressures. Specifically, the apparatus enables an operator to control the pressure in both the upper and lower cavities 20, 38. The difference between the pressures in the upper and lower cavities 20, 38 drives the workpiece 12 towards one of the mold surfaces 22, 40. Use of differential pressures imposes a hydrostatic pressure on the workpiece 12 that helps to prevent the onset of cavitation and delay failure in the workpiece 12.

While the cavity 38 located in the lower die member 18 is shown with a forming surface 40, it should be understood that the cavity 38 in the lower die member 18 need not have a forming surface 40. Instead, in some instances, a cavity or space suitable to create a pre-form bubble that enables pre-stretching of the workpiece 12 is all that is required. When forming complex shapes with geometric configurations, however, it may be necessary to pre-stretch the workpiece 12 over a specifically configured forming surface prior to forming the workpiece 12 against the mold surface 22.

Figure 6:
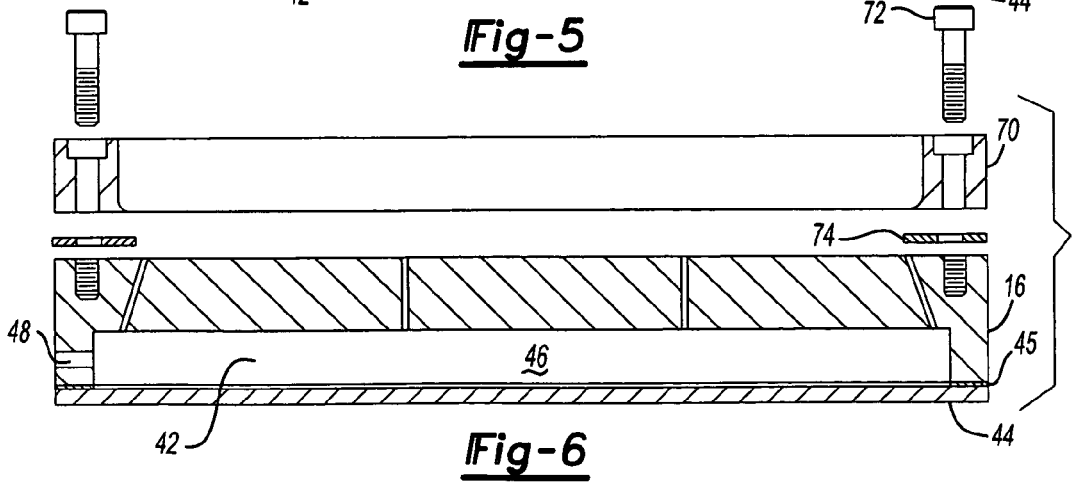
FIG. 6 is a cross-sectional view of illustrating an alternative embodiment of the present according to the present invention utilizing an insert to create the pre-form cavity.

An additional embodiment of the present invention is illustrated in FIG. 6 showing the use of an insert 70 as part of the lower die member 18. The insert 70 is added to existing superplastic forming dies wherein the lower die member 18 as a flat or planar surface. Accordingly, if a cavity is needed to pre-stretch or pre-form the workpiece 12 prior to the final forming process or step taking place, the insert 70 is attached to the lower die member 18. One method of attaching the insert 70 includes using a plurality of fasteners 72 and a gasket 74 placed between the insert 70 and the lower die member 18 to produce a sealed pressure cavity. Accordingly, the insert 70 provides quick and inexpensive changes-to a superplastic forming tool to make reverse gas pressure pre-forming possible.

Accordingly, the above-disclosed superplastic forming tool and superplastic forming process expands forming limits, reduces part-to-part cycle time and produces a part with more uniform part thickness. This process can be applied to new dies or by retrofitting existing dies to include a plurality of passageways connected to a common plenum.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A superplastic forming tool comprising:

a forming die, said forming die including first and second die members, said die members operative to move between a first open position and a second closed position;

said first die member having a cavity, said cavity including a mold surface;

said first die member having a recessed area;

a cap, said cap connected to said first die member, wherein said cap cooperates with said recessed area to create a plenum;

an aperture in said first die member, said aperture communicating with said plenum; and a plurality of passageways extending from said plenum to said cavity, said passageways operative to allow passage of fluid between said cavity and said plenum.

2. A superplastic forming tool as set forth in claim 1 including said second die member having a cavity and a recessed area, a cap attached to said second die member wherein said cap cooperates with said recessed area to create a plenum;

an aperture in said second die member, said aperture communicating with said plenum; and a plurality of passageways extending from said plenum to said cavity, said passageways operative to allow passage of fluid between said cavity and said plenum.

3. A superplastic forming tool as set forth in claim 2, wherein said cavity includes a forming surface.

4. A superplastic forming tool as set forth in claim 1 including an aperture in said first die member extending between said plenum and an outer surface of said first die member, said aperture providing passageway for fluid flow into and out of said plenum.

5. A superplastic forming tool comprising:

a forming die, said forming die including first and second die members, said die members operative to move between a first open position and a second closed position;

said first die member having a cavity, said cavity including a mold surface;

said first die member having a recessed area;

a cap, said cap fastened to said first die member, wherein said cap closes said recessed area to create a plenum;

an aperture in said first die member, said aperture communicating with said plenum;

a plurality of passageways extending from said plenum to said cavity, said passageways operative to allow passage of fluid between said cavity and said plenum; and a gasket located between said cap and said first die member.

6. A superplastic forming tool as set forth in claim 5 wherein said plurality of passageways are all connected to a common plenum.

7. A superplastic forming tool as set forth in claim 5 including said second die member having a cavity.

8. A superplastic forming tool as set forth in claim 7 including a plurality of passageways connected to said cavity of said second die member.

9. A superplastic forming tool comprising:

a forming die, said forming die including first and second die members, said die members operative to move between a first open position and a second closed position;

said first die member having a cavity and a recessed area, a cap attached to said first die member wherein said cap cooperates with said recessed area to create a plenum;

an aperture in said first die member, said aperture communicating with said plenum in said first die member;

a plurality of passageways located in said first die member extending from said plenum to said mold cavity of said first die member, said passageways operative to allow passage of fluid between said cavity and said plenum;

a second die member having a cavity and a recessed area, a cap attached to said second die member wherein said cap cooperates with said recessed area to create a plenum;

an aperture in said second die member, said aperture communicating with said plenum in said second die member; and a plurality of passageways in said second die member extending from said plenum to said cavity and said second die member, said passageways operative to allow passage of fluid between said cavity and said plenum.

10. A superplastic forming tool as set forth in claim 9 wherein said cavity of said second forming die includes a forming surface.

11. A superplastic forming tool as set forth in claim 9 wherein said plurality of passageways in said first die member are connected to a common plenum.

12. A method of superplastic forming a workpiece comprising the steps of:

providing a superplastic forming tool, said forming tool having a first die member and a second die member, said first die member and said second die member operative to move between a first, open position and a second, closed position;

placing a workpiece between the first and second die members when said first and second die members are in the open position;

moving said first and second die members, to said second, closed position wherein said workpiece is sandwiched between said first and second die members;

providing said first die member with a recessed area and a cap, the recessed area and the cap cooperating to form a plenum, a forming cavity including a forming surface and a plurality of passageways extending between said plenum and said forming cavity;

providing the second die member with a recessed area and a cap, the recessed area and the cap cooperating to form a plenum, a cavity and a plurality of passageways extending between said plenum and said cavity;

applying pressure from the plenum of the first die member through the passageways on the first die member to one side of the workpiece to urge the workpiece into the cavity of the second die member;

after reaching a certain point of deflection of said workpiece, applying pressure from the plenum of the second die member through the passageways of the second die member on the opposite side of the workpiece to urge the workpiece toward the first die member and into the forming cavity of the first die member and ultimately against the mold surface of the first die member to form the workpiece.

13. A method of superplastic forming a workpiece as set forth in claim 12 including the step of:

providing the cavity of the second die member with a forming surface; and forming the workpiece on the forming surface of the second die member.

14. A method of superplastic forming a workpiece as set forth in claim 12 including the step of:

supplying pressure in the form of a pressurized gas to the plenum of said first die member and the plenum of said second die member.

15. A method of superplastic forming a workpiece as set forth in claim 12 including the step of:

collecting the pressurized gas used to form the workpiece exiting the forming cavity of the first die member and that cavity of the second die member.

16. A method of superplastic forming a workpiece comprising the steps of:

providing a superplastic forming tool, said forming tool having a first die member and a second die member, said first die member and said second die member operative to move between a first, open position and a second, closed position;

placing a workpiece between the first and second die members when said first and second die members are in the open position;

moving said first and second die members, to said second, closed position wherein said workpiece is sandwiched between said first and second die members;

providing said first die member with a plenum, a forming cavity including a forming surface and a plurality of passageway extending between said plenum and said forming cavity;

providing the second die member with a plenum, a cavity and a plurality of passageways extending between said plenum and said cavity;

applying pressure from the plenum of the first die member through the passageways on the first die member to one side of the workpiece to urge the workpiece into the cavity of the second die member;

after reaching a certain point of detection of said workpiece, applying pressure from the plenum of the second die member through the passageways of the second die member on the opposite side of the workpiece to urge the workpiece towards the first die member and into the forming cavity of the first die member and ultimately against the mold surface of the first die member to form the workpiece; and applying pressure to the plenum of said first die member and correspondingly the cavity of said first die member and to the plenum of said second die member and correspondingly the cavity of said second die member at the same time wherein the pressure in one of the first die cavity and second die cavity is greater whereby the difference between the respective pressures in the first die cavity in the second die cavity drives the workpiece toward one of the first and second die members.

17. A method of superplastic forming a workpiece comprising the steps of:

providing a superplastic forming tool, said forming tool having a first die member and a second die member, said first die member and said second die member operative to move between a first, open position and a second, closed position;

placing a workpiece between the first and second die members when said first and second die members are in the open position;

moving said first and second die members, to said second, closed position wherein said workpiece is sandwiched between said first and second die members;

providing said first die member with a plenum, a forming cavity including a forming surface and a plurality of passageways extending between said plenum and said forming cavity;

providing the second die member with a plenum, a cavity and a plurality of passageways extending between said plenum and said cavity; and applying pressure from the plenum of the first die member through the passageways on the first die member to one side of the workpiece to urge the workpiece into the cavity of the second die member;

after reaching a certain point of deflection of said workpiece, applying pressure from the plenum of the second die member through the passageways of the second die member on the opposite side of the workpiece to urge the workpiece toward the first die member and into the forming cavity of the first die member and ultimately against the mold surface of the first die member to form the workpiece; and applying pressure to both sides of the workpiece at the same time to impose a hydrostatic pressure on the workpiece.

18. A method of superplastic forming a workpiece as set forth in claim 17 including the step of:

controlling the pressure in both the first die cavity and second die cavity whereby a difference between the pressures in the first die cavity and second die cavity drives the workpiece towards one of the die members.

19. A superplastic forming tool comprising:

a forming die, said forming die including first and second die members, said die members operative to move between a first open position and a second closed position;

said first die member having a cavity, said cavity including a mold surface;

said first die member having a recessed area;

a cap, said cap fastened to said first die member, wherein said cap covers said recessed area to create a plenum;

an aperture in said first die member, said aperture communicating with said plenum; and a plurality of passageways extending from said plenum to said cavity, said passageways operative to allow passage of fluid between said cavity and said plenum.

20. A superplastic forming tool as set forth in claim 19 including an aperture in said first die member extending between said plenum and an outer surface of said first die member, said aperture providing passageway for fluid flow into and out of said plenum.

* * * * *